US009014403B2

(12) United States Patent
Miyoshi et al.

(10) Patent No.: US 9,014,403 B2
(45) Date of Patent: Apr. 21, 2015

(54) EARPHONE AND EAR-WORN BONE CONDUCTION DEVICE

(71) Applicant: National University Corporation Kanazawa University, Ishikawa (JP)

(72) Inventors: Masato Miyoshi, Ishikawa (JP); Toshiyuki Ueno, Ishikawa (JP)

(73) Assignee: National University Corporation Kanazawa University, Ishikawa (JP)

( * ) Notice: Subject to any disclaimer, the term of this patent is extended or adjusted under 35 U.S.C. 154(b) by 0 days.

(21) Appl. No.: 13/765,794

(22) Filed: Feb. 13, 2013

(65) Prior Publication Data

US 2013/0259271 A1 Oct. 3, 2013

(30) Foreign Application Priority Data

Apr. 2, 2012 (JP) ..... 2012-084293

(51) Int. Cl.

| | |
|---|---|
| ***H04R 25/00*** | (2006.01) |
| ***H04R 15/00*** | (2006.01) |
| ***H04R 1/10*** | (2006.01) |
| *H04R 31/00* | (2006.01) |

(52) U.S. Cl.

CPC ..... *H04R 15/00* (2013.01); *H04R 1/1016* (2013.01); *H04R 31/00* (2013.01); *H04R 2460/13* (2013.01)

(58) Field of Classification Search

USPC ..... 381/191, 152, 190

See application file for complete search history.

(56) References Cited

U.S. PATENT DOCUMENTS 5,355,351 A * 10/1994 Yoshikawa et al. ..... 367/156
8,254,603 B2 * 8/2012 Suzuki et al. ..... 381/191

FOREIGN PATENT DOCUMENTS

JP 11-266496 9/1999
JP 2004-057261 2/2004

OTHER PUBLICATIONS

"Audio Bone", Goldendance.co.,Ltd., http://www.goldendance.co.jp/product/p_ab01.html (http:/ /www.goldendance.co.jp/English/product/p_ab01.html), search on Mar. 14, 2011.

"Ear-Worn Bone Conduction Device (Unpublished application)", J-Store, May 31, 2011, http:/ /jstore.jst.go.jp/nationalPatentDetail.html?pat_id=24214&_ssn=UC211P21S010_2, with partial English translation.

(Continued)

*Primary Examiner* — Davetta W Goins

*Assistant Examiner* — Amir Etesam

(74) *Attorney, Agent, or Firm* — Wenderoth, Lind & Ponack, L.L.P.

(57) ABSTRACT

An earphone comprises: a magnetostrictive element which is composed of a magnetostrictive material and has a column-like shape, the magnetostrictive element expanding and contracting due to magnetostrictive effect; a coil wound around the magnetostrictive element, the coil converting an electrical signal into a change in magnetic field; and an elastic portion which is composed of an elastic body having magnetism, the elastic portion including: a first elastic portion to which one of ends of the magnetostrictive element is joined; a second elastic portion to which the other end of the magnetostrictive element is joined; and a beam portion having a column-like shape and being provided in parallel to the magnetostrictive element between the first elastic portion and the second elastic portion and being integrally formed with the first elastic portion and the second elastic portion.

14 Claims, 9 Drawing Sheets

(56) References Cited

OTHER PUBLICATIONS

"Ear-Worn Bone Conduction Device", Kanazawa University Technology Licensing Organization (KUTLO), patent application day: Apr. 4, 2011, http://kutlo.incu.kanazawa-u.ac.jp/invention/other (p. 1, No. 2011-005) and http://kutlo.incu.kanazawa-u.ac.jp/wp-content/uploads/2010/09/kaiji.pdf (p. 40. No. 31) with partial English translation.

Hidemitsu Miura et al., "Vibration Evaluation of Hollow Bone Conductive Earphone", Joint Conference of Hokuriku Chapters of Electrical Societies 2011, A-73, Sep. 17, 2011, with English translation.

"Bone Conduction Earphone Developed by Toshiyuki Ueno, Associate Professor of Kanazawa University", Hokkoku Shimbun Newspaper. Nov. 22, 2011, http://www.hokkoku.co.jp/subpage/H20111122105.htm, with English translation.

* cited by examiner

EARPHONE AND EAR-WORN BONE CONDUCTION DEVICE

CROSS REFERENCE TO RELATED APPLICATION

The present application is based on and claims priority of Japanese Patent Application No. 2012-084293 filed Apr. 2, 2012. The entire disclosure of the above-identified application, including the specification, drawings and claims is incorporated herein by reference in its entirety.

FIELD

The present invention relates to earphones and ear-worn bone conduction devices, and in particular relates to an earphone and an ear-worn bone conduction device which convert an obtained electrical signal into vibrations.

BACKGROUND

Conventionally, an earphone is known as a technique for using a speaker.

As a conventional earphone (speaker), a voice coil type earphone using an electromagnet and an earphone using a piezoelectric element are known (for example, refer to Patent Literatures 1 and 2).

A type of earphones includes earphones used through fitting into ear holes and headset earphones used through putting the vibrator on the temples.

CITATION LIST

Patent Literature

Patent Literature 1: Japanese Unexamined Patent Application Publication No. 2004-057261

Patent Literature 2: Japanese Unexamined Patent Application Publication No. 11-266496

Non Patent Literature

Non Patent Literature 1: Goldendance Co., Ltd., AUDIO BONE [online], Goldendance Co., Ltd. [search on Mar. 14, 2011], Internet <http://www.goldendance.co.jp/product/p_ab01.html>

SUMMARY

Technical Problem

However, the earphones disclosed in Patent Literatures 1 and 2 seal an ear canal with the earphone itself, making it difficult for a user to hear surrounding sounds other than sounds reproduced by the earphone.

Even in the environment with large noise, it is highly necessary for a user to hear surrounding sounds such as warning sound or a screaming sound informing the user of danger that are not output by the earphone. When listening to background music (BGM) while jogging, it is highly necessary for the user to hear surrounding sounds while listening to the BGM. In order to secure the safety of the user, an earphone is necessary for users to easily hear not only sounds reproduced by the earphone but also surrounding sounds.

Conventionally, as disclosed in Non Patent Literature 1, a bone conduction speaker is known for transmitting a bone conduction sound to the user by putting a vibrator tightly on the user's temple or bone near the ear. However, since the vibrator needs to be pinned down on the bone through the skin, the user is faced with a high degree of invasiveness and always feels uncomfortable with the vibrator. Moreover, there is a demerit that the bone conduction speaker is enlarged.

Therefore, the aim of the present invention is to provide an earphone and ear-worn bone conduction device which have a low degree of invasiveness and do not prevent the user from hearing surrounding sounds.

Solution to Problem

An earphone according to an aspect of the present invention comprises: a magnetostrictive element which is composed of a magnetostrictive material and has a column-like shape, the magnetostrictive element expanding and contracting due to magnetostrictive effect; a coil wound around the magnetostrictive element, the coil converting an electrical signal into a change in magnetic field; and an elastic portion which is composed of an elastic body having magnetism, the elastic portion including: a first elastic portion to which one of ends of the magnetostrictive element is joined; a second elastic portion to which the other end of the magnetostrictive element is joined; and a beam portion having a column-like shape and being provided in parallel to the magnetostrictive element between the first elastic portion and the second elastic portion and being integrally formed with the first elastic portion and the second elastic portion.

With this configuration, since the vibrations corresponding to an electrical signal are transmitted from the magnetostrictive element via the elastic portion, the user can perceive the sound corresponding to the electrical signal. Moreover, in the earphone, since the elastic portion has an opening (a through hole), the user can perceive surrounding sounds which pass through the opening. With this, the user can hear surrounding sounds as well as sound from the earphone while wearing the earphone. Moreover, since the earphone is used by inserting it into the ear hole, the earphone, different from the headset, does not have to put pressure on the head region of the user when the earphone is worn. Therefore, with a low degree of invasiveness, it is possible to provide the earphone which does not prevent the user from hearing surrounding sounds.

Moreover, the first elastic portion may include a first magnet configured to apply a bias magnetic field to the magnetostrictive element, the second elastic portion includes a second magnet configured to apply a bias magnetic field to the magnetostrictive element, and the first magnet and the second magnet have a same magnetic pole orientation, and may be located in an orientation in which each of the first magnet and the second magnet generates a magnetic field in a same direction as a longitudinal direction of the magnetostrictive element.

With this configuration, the magnetostrictive element is moderately expanded by a bias magnetic field caused by the magnet. In other words, by applying the bias magnetic field through the magnet, the magnetostrictive element can be expanded in advance. Therefore, the magnetostrictive element can be positively and negatively displaced by corresponding to positive and negative values.

Moreover, the elastic portion may include a diaphragm around which the elastic portion abuts against an ear hole.

With this configuration, the diaphragm can be located along with the shape of the user's ear hole. Therefore, the vibrations which are transmitted to the elastic portion after the conversion of an electrical signal into vibrations by the magnetostrictive element can be efficiently transmitted as sound waves.

Moreover, the elastic portion may have a circular shape when viewed in a direction in which the elastic portion is located inside the ear hole, and may become thinner in an area to be located inside the ear hole than in an area to be located at an entrance side of the ear hole.

With this configuration, the earphone can be deeply located along with the shape of the user's ear hole.

Moreover, the elastic portion may have a circular shape when viewed in a direction in which the elastic portion is located inside the ear hole, and may include a step which makes the elastic portion thinner in an area to be located inside the ear hole than in an area to be located at an entrance side of the ear hole.

With this configuration, the earphone can fit deeply into the shape of the user's ear hole.

The ear-worn bone conduction device according to an aspect of the present invention includes the earphone having the above described features, and the elastic portion abuts against an ear canal and transmits vibrations between the magnetostrictive element and the ear canal.

With this configuration, since the vibrations corresponding to an electrical signal are transmitted from the magnetostrictive element to the ear canal via the elastic portion, the user can perceive, as a bone conduction sound, the sound corresponding to the electrical signal. Moreover, since in the ear-worn bone conduction device, the elastic portion has an opening (a through hole), the user can obtain, as an air conduction sound, surrounding sounds that pass through the opening. With this, the user can hear the sound corresponding to the electrical signal and the surrounding sounds while wearing the ear-worn bone conduction device. Moreover, since the ear-worn bone conduction device is used by inserting it into the ear canal, the ear-worn bone conduction device, different from the headset, does not have to put pressure on near the head region of the user when the ear-worn bone conduction device is worn. Therefore, with a low degree of invasiveness, it is possible to provide the ear-worn bone conduction device which does not prevent the user from hearing surrounding sounds.

Moreover, the magnetostrictive element is moderately expanded by a bias magnetic field caused by the magnet. In other words, by applying the bias magnetic field through the magnet, the magnetostrictive element can be expanded in advance. Therefore, the magnetostrictive element can be positively and negatively displaced by corresponding to positive and negative values.

Moreover, the ear-worn bone conduction device can fit deeply into the shape of the user's ear hole.

Furthermore, the present invention can be implemented as an ear-worn bone conduction system including the above described ear-worn bone conduction device.

As described above, the present invention can provide an earphone and ear-worn bone conduction device which have a low degree of invasiveness and do not prevent the user from hearing surrounding sounds.

BRIEF DESCRIPTION OF DRAWINGS

These and other objects, advantages and features of the disclosure will become apparent from the following description thereof taken in conjunction with the accompanying drawings that illustrate a specific embodiment of the present disclosure.

DESCRIPTION OF EMBODIMENTS

The following will describe in detail the embodiments of an earphone according to the present invention with reference to the drawings. It should be noted that the following descriptions will show specific favorable examples according to the present embodiments. Therefore, the following numeral values, shapes, materials, structural elements, the arrangement position and connection form of the structural elements are mere examples, which are not intended to limit the present invention. Among the structural elements in the following embodiments, structural elements not recited in any of the independent claims indicating the most generic concept of the present invention are described as arbitrary structural element comprising a more favorable embodiment.

Embodiment 1

Figure 1:
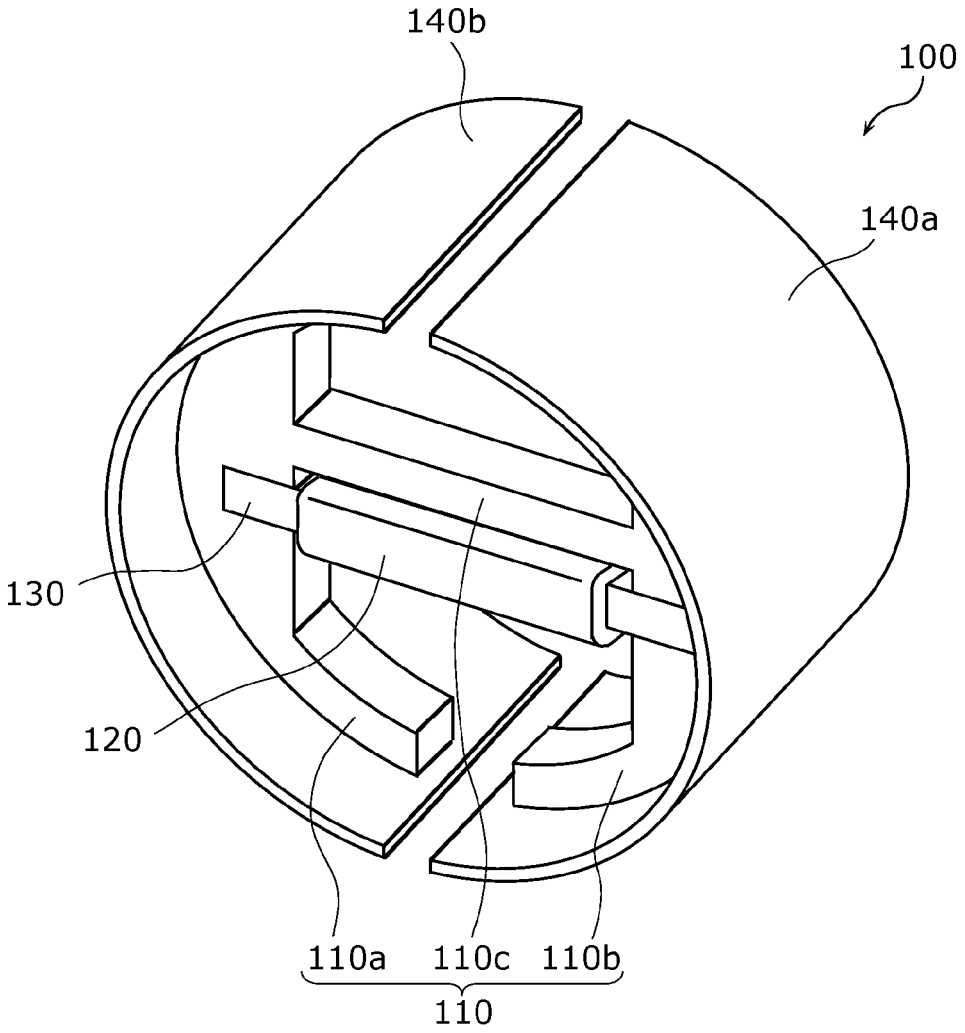
FIG. 1 is a schematic view showing the configuration of an earphone according to Embodiment 1.

FIG. 1 is a schematic view of an earphone 100 according to Embodiment 1.

As shown in FIG. 1, the earphone 100 includes an elastic portion (yoke and frame) 110, a magnetostrictive element 130, a coil 120, and diaphragms 140*a* and 140*b*.

The elastic portion 110 is formed of an elastic body having magnetism, and the elastic portion 110 includes a first elastic portion 110*a* to which one of the ends of the magnetostrictive element 130 is joined, a second elastic portion 110*b* to which the other end of the magnetostrictive element 130 is joined, and a beam portion 110*c* having a column-like shape which is provided in parallel to the magnetostrictive element 130 between the first elastic portion 110*a* and the second elastic portion 110*b* and which is integrally formed with the first elastic portion 110*a* and the second elastic portion 110*b*.

The elastic portion 110 vibrates by vibrations of the magnetostrictive element 130. The elastic portion 110 has a ring-like shape such that the earphone 100 abuts against the ear hole (ear canal) without imposing a burden on the user. It should be noted that as described later, the elastic portion 110 does not categorically have to be a completely ring-like shape. For example, the elastic portion 110 according to the present embodiment has two interspaces, one of which is located at the top and the other of which is located at the bottom. The elastic portion 110 includes the first elastic portion 110*a* and the second elastic portion 110*b* that partially have arc-like shapes, and the beam portion 110*c* having a column-like shape which is provided between the first elastic portion 110*a* and the second elastic portion 110*b* and which is integrally formed with the first elastic portion 110*a* and the second elastic portion 110*b* such that the beam portion 110*c* can be connected between the first elastic portion 110*a* and the second elastic portion 110*b*.

The elastic body constituting the elastic portion 110 is composed of, for example, ferrite stainless steel SUS430 which is made into an almost H shape.

The diaphragms 140*a* and 140*b* are joined to the arc-shaped portions of the first elastic portion 110*a* and the second elastic portion 110*b*, respectively. The diaphragms 140*a* and 140*b*, which are composed of steel thin plate, for example, transmit vibrations between the ear hole and the magnetostrictive element 130 by making the diaphragms 140*a* and 140*b* abut against the ear hole. The diaphragms 140*a* and 140*b* may be not only steel but also metals such as stainless and aluminum, as well as resin, rigid rubber, and the like. By selecting the material and the shape for the elastic body, it is possible to adjust resonance frequency.

The magnetostrictive element 130 is a magnetostrictive material formed in a column-like shape. The ends of the magnetostrictive element 130 are joined to the first elastic portion 110*a* and the second elastic portion 110*b*, respectively, that are the parts of the elastic portion 110. The magnetostrictive element 130 is composed of Galfenol, for example, which is processed into $1\times1\times3$ $mm^3$ of a quadrangular prism.

Moreover, the magnetostrictive element 130 is provided in parallel to the beam portion 110*c* of the elastic portion 110. In other words, in the earphone 100, the beam portion 110*c* of the elastic portion 110 and the magnetostrictive element 130 form a parallel beam structure. Moreover, the beam portion 110*c* exists in a position displaced from the central position of the ring-like shape of the elastic portion 110, and the ends are integrally formed with the first elastic portion 110*a* and the second elastic portion 110*b*. Moreover, the magnetostrictive element 130 also exists in a position displaced from the central position of the ring-like shape of the elastic portion 110, and each of the ends of the magnetostrictive element 130 is joined to a corresponding one of the first elastic portion 110*a* and the second elastic portion 110*b*. Favorably, the central position of the ring-like shape of the elastic portion 110 may be located between the parallel beams formed of the beam portion 110*c* and the magnetostrictive element 130.

With this, a magnetic field is applied in a longitudinal direction of the magnetostrictive element 130, and the magnetostrictive element 130 expands. Since the magnetostrictive element 130 is constrained by the beam portion 110*c*, the beam portion 110*c* performs bending deformation by the expansion of the magnetostrictive element 130. With this, since the first elastic portion 110*a* and the second elastic portion 110*b* are also deformed, the diaphragms 140*a* and 140*b* provided at the elastic portion 110 are displaced. Meanwhile, when the magnetic field disappears, the length of the magnetostrictive element 130 returns to normal. In other words, the magnetostrictive element 130 repeats the expansion and contraction by the magnetic field in a longitudinal direction.

Moreover, since bending deformation occurs to the beam portion 110*c* by the expansion and contraction of the magnetostrictive element 130, the elastic portion 110 vibrates. More specifically, with reference to FIG. 1, when the magnetostrictive element 130 expands, the width of the upper interspace of the elastic portion 110 contracts while the width of the lower interspace of the elastic portion 110 expands. Conversely, when the magnetostrictive element 130 contracts, the width of the lower interspace of the elastic portion 110 contracts while the width of the upper interspace of the elastic portion 110 expands.

By repeating this, the diaphragms 140*a* and 140*b* connected to the elastic portion 110 vibrate, and then vibrations in the audible range are generated. The vibrations travel through the air as sound waves, and reach the user's tympanic membrane, thus allowing the user to perceive the vibrations as sound.

As described above, the magnetostrictive element 130 converts an electrical signal into expansion and contraction displacement in an axis direction. With the configuration of the earphone 100 according to the present embodiment, the electrical signal is further converted from the expansion and contraction displacement in the axis direction of the magnetostrictive element 130 into flexural displacement in a direction that is orthogonal to the axis direction.

When the expansion and contraction displacement is used, a large electrical signal can be obtained from a small displacement. Conversely, when the flexural displacement is used, a large electrical signal can be obtained from a small displacement. In the configuration of the above described earphone 100, large displacement (vibrations) can be obtained from a small force (electrical signal). Therefore, the earphone 100 can efficiently convert an electrical signal into vibrations, using the expansion and contraction displacement as well as the flexural displacement.

In this way, by forming the parallel beam structure with the beam portion 110*c* of the elastic portion 110 and the magnetostrictive element 130, the earphone can be realized in which the structure is simpler and an electrical signal can be efficiently converted into vibrations.

As a material for the magnetostrictive element 130, a piezoelectric element and a giant magnetostrictive element used in an earphone (speaker) according to a related technique can be used, but it is favorable that a magnetostrictive material having ductility such as an iron-gallium alloy is used for the following reason.

The piezoelectric element is fragile, and is highly likely to be broken because it cannot withstand the load of stress. Moreover, the giant magnetostrictive element (Tb—Dy—Fe alloy) is also fragile, and has a defect that it cannot withstand the load of stress.

Meanwhile, since the magnetostrictive material having ductility such as an iron-gallium alloy is easily processed and robust, it is unlikely to be broken. Therefore, a magnetostrictive material such as an iron-gallium alloy is suitable for the earphone 100 inserted into the ear canal.

The coil 120 is wound around the magnetostrictive element 130, and conducts an electrical signal. In other words, as described later, when the earphone 100 functions as a speaker, the coil 120 converts to a change in magnetic field from a change in the current value that is an electrical signal obtained by the earphone 100. Meanwhile, when the earphone 100 functions as a microphone, the coil 120 converts from a change in magnetic flux of the magnetostrictive element 130 caused by vibrations to a change in induced voltage generated in the coil 120. The coil 120 is composed of fine copper wire, and is an excitation coil having 67 turns and 10Ω resistance.

Figure 2:
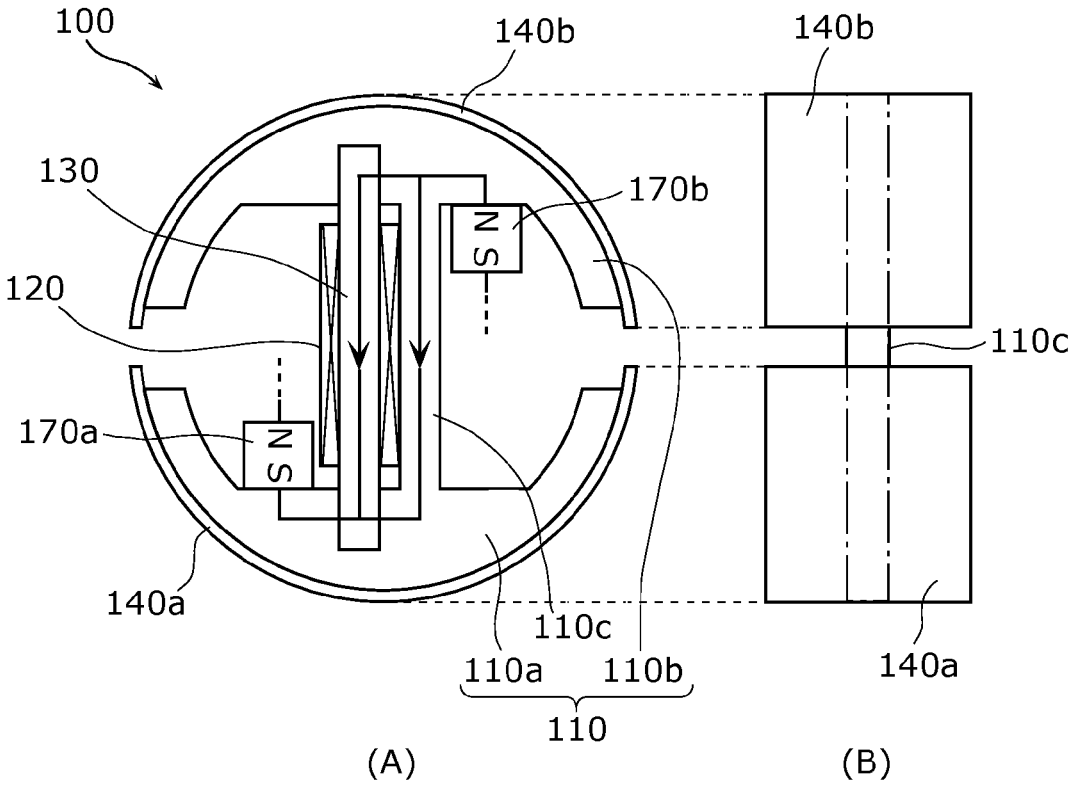
FIG. 2 is a schematic view showing the configuration of the earphone according to Embodiment 1.

FIG. 2 is a diagram showing the configuration of the earphone 100 according to the present embodiment. More specifically, (A) of FIG. 2 is an elevation view of the earphone 100 according to the present embodiment. More specifically, (B) of FIG. 2 is a right side view of the earphone 100 according to the present embodiment.

With reference to (A) of FIG. 2, the diameter of the ring-like shape of the elastic portion 110 is around one centimeter, which is aligned with the size of the ear hole. Moreover, the diameter of the magnetostrictive element 130 is around one millimeter.

Moreover, as shown in (A) of FIG. 2, the earphone 100 has a large opening in a vertical direction of the magnetostrictive element 130 and the coil 120. The opening is large enough to allow the surrounding sounds to pass, and therefore the user can hear sound from the earphone 100 and the surrounding sounds at the same time.

Moreover, as shown in (A) of FIG. 2, the first elastic portion 110*a* is provided with a magnet 170*a*, and the second elastic portion 110*b* is provided with a magnet 170*b*. The magnets 170*a* and 170*b* each are composed of, for example, a permanent magnet. Since a bias magnetic field is applied to the magnetostrictive element 130 via the beam portion 110*c*, the magnetic pole orientations are matched between the magnets 170*a* and 170*b*, and the magnets 170*a* and 170*b* are located in an orientation in which a magnetic field is generated in a direction in which the longitudinal directions are matched between the magnetostrictive element 130 and the beam portion 110*c*. For example, in (A) of FIG. 2, when the magnetic poles of the magnet 170*a* are a north pole on the top side and a south pole on the bottom side, the magnetic poles of the magnet 170*b* are also located such that a north pole is on the top side and a south pole is on the bottom side. The magnets 170*a* and 170*b* each are composed of, for example, neodymium magnet of $2\times3\times2$ $mm^3$. Moreover, the elastic portion 110 may include a back yoke between the magnets 170*a* and 170*b*.

With this configuration, the magnetostrictive element 130 is moderately expanded by a bias magnetic field caused by the magnets 170*a* and 170*b*. For the description, this state is referred to as a steady state.

In the steady state, when a magnetic flux is generated by the magnets 170*a* and 170*b* in the same orientation as the magnetic flux generated by current flowing in the coil 120, the intensity of the magnetic field through the magnetostrictive element 130 is greater and therefore the magnetostrictive element 130 is further expanded. Meanwhile, when (i) the orientation of current flowing in the coil 120 is the opposite to the orientation in the above case and (ii) a magnetic flux is generated by the magnets 170*a* and 170*b* in the opposite orientation to the magnetic flux generated by current flowing in the coil 120, the magnetic fluxes are cancelled with each other and therefore the length of the magnetostrictive element 130 is shorter than that of the steady state. With this, according to the positive and negative of current in an electrical signal including sound information, it is possible to cause the magnetostrictive element 130 to vibrate.

More specifically, for example, when (i) the current value in the electrical signal is positive and (ii) the orientation of a magnetic flux caused by the coil 120 is the same as the orientation of a magnetic flux caused by a bias magnetic field, the magnetostrictive element 130 expands when the current value is positive and the magnetostrictive element 130 contracts when the current value is negative.

Generally, an electrical signal (that is to say, a sound signal) outputted from the sound player or amplifier is a positive or negative value. However, the magnetostrictive element 130 is only deformed in an expansion direction independently of the orientation of the magnetic field. Therefore, by slightly expanding the magnetostrictive element 130 in advance, the displacement of the magnetostrictive element 130 can correspond to a positive or negative electrical signal. With this, sound corresponding to an electrical signal can be generated.

Figure 3:
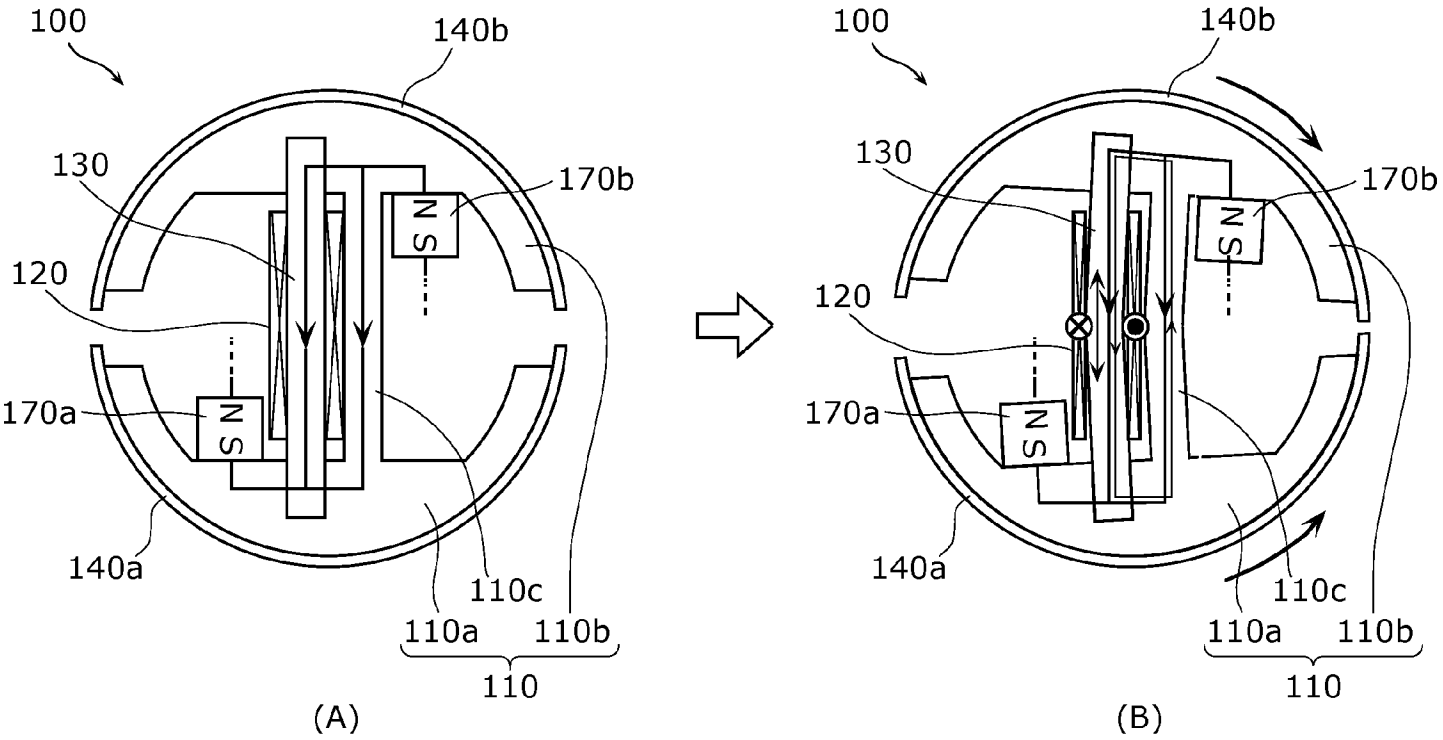
FIG. 3 is a schematic view showing an operation of the earphone according to Embodiment 1.

(A) and (B) of FIG. 3 each are a schematic view showing the operation of the earphone 100 according to the present embodiment.

As shown in (A) of FIG. 3, the earphone 100 includes the elastic portion 110, the magnetostrictive element 130, the coil 120, the magnets 170*a* and 170*b*, and the diaphragms 140*a* and 140*b* having a semi-cylindrical shape. The size of the earphone 100 is the size that allows the earphone 100 to fit into the ear hole. Here, when the current corresponding to the sound signal flows in the coil 120 of the earphone 100, the magnetostrictive element 130 expands and contracts due to magnetostrictive effect. In other words, as shown in (B) of FIG. 3, the expansion and contraction of the magnetostrictive element 130 is converted into bending deformation in the parallel beams composed of the magnetostrictive element 130 and the beam portion 110*c*, and displaces the diaphragms 140*a* and 140*b* joined to the outside of the elastic portion 110. Therefore, by inserting the earphone 100 into the ear hole and locating the diaphragms 140*a* and 140*b* to be in contact with the skin, the diaphragms 140*a* and 140*b* provide vibrations to the user's cartilage. The vibrations are perceived by the user as sound via the user's tympanic membrane of the earphone 100. Moreover, when the vibrations of the diaphragms 140*a* and 140*b* are large, the vibrations are transmitted to the external ear cartilage of the user's ear hole and therefore sound is perceived as a bone conduction sound.

Figure 4:
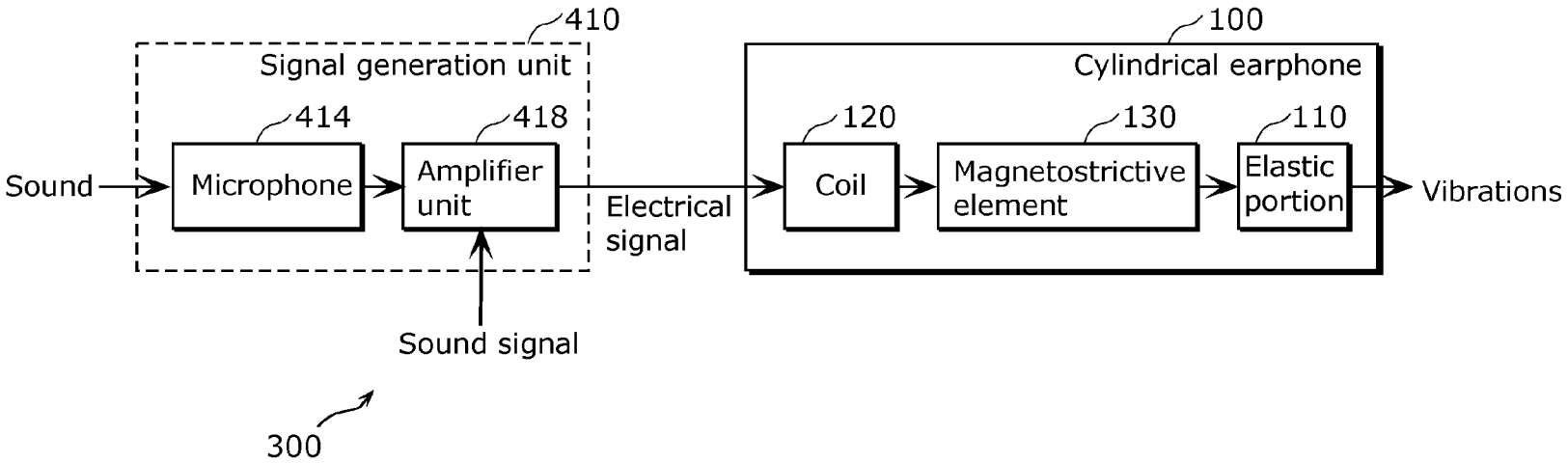
FIG. 4 is a block diagram showing a functional configuration of an earphone system including the earphone according to Embodiments 1 to 5.

Here, as shown in FIG. 4, the functional configuration of an earphone system including the earphone 100 will be described. FIG. 4 is a block diagram of an earphone system 300 including the earphone 100 according to the present embodiment.

As shown in FIG. 4, the earphone system 300 includes a signal generation unit 410 and the earphone 100.

The signal generation unit 410, for example, with reference to FIG. 2, is included in a signal generation device 904 that is an external device of the earphone 100. The signal generation unit 410 includes a microphone 414 and an amplifier unit 418.

The sound inputted from the microphone 414 is converted into an electrical signal, and the electrical signal is amplified by the amplifier unit 418, and is transmitted to the earphone 100. The communication standard between the signal generation unit 410 and the earphone 100 may be both of fixed line or wireless. In terms of user convenience, however, the wireless communication standard for making it possible to miniaturize a communication module, such as Bluetooth (registered trademark) and the like, is favorable. Moreover, when sound of a portable music player or the like is reproduced, a configuration is possible in which the sound signal is directly inputted into the amplifier unit 418.

Next, the electrical signal that the earphone 100 obtained from the signal generation unit 410 is inputted into the coil 120. The electrical signal inputted into the coil 120 has the strength and weakness of current by corresponding to the sound inputted from the microphone 414. The strength and weakness of current is converted, by the coil 120, into the strength and weakness of the magnetic field generated by the coil 120.

Furthermore, the strength and weakness of the magnetic field is converted into vibrations by the magnetostrictive element 130, and the vibrations are transmitted to the elastic portion 110. The vibrations of the elastic portion 110 are perceived by the user as sound via the user's tympanic membrane of the earphone 100. Moreover, the user can completely hear the surrounding sounds through openings of the elastic portion 110 of the earphone 100. For example, at such locations as factories and restaurants, the user can hear the surrounding sounds and operation noise as well as the sound of instruction from the operation center via the earphone.

Figure 5:
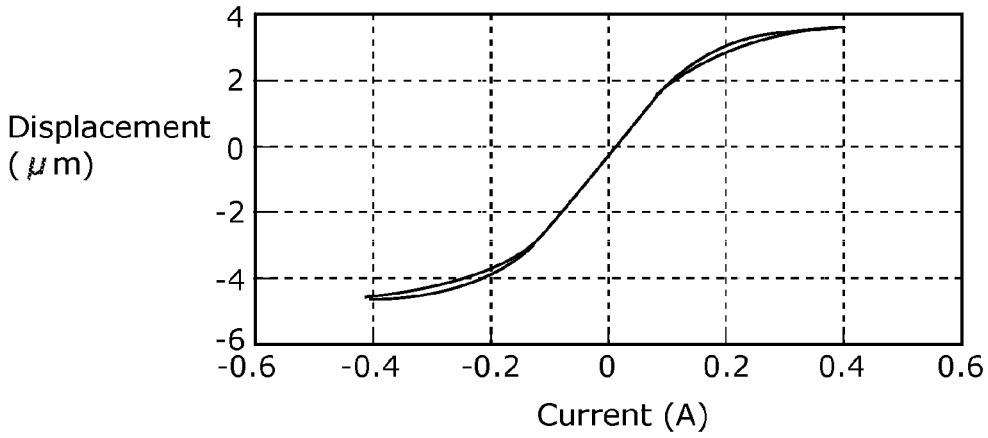
FIG. 5 is a schematic view showing displacement of a magnetostrictive element with respect to excitation current of the earphone according to Embodiment 1.

FIG. 5 is a graph showing displacement of the magnetostrictive element 130 with respect to excitation current of the earphone 100.

As shown in FIG. 5, it is found that in the earphone 100 according to the present embodiment, when the current (excitation current) flowing in the coil 120 is increased, the amount of displacement of the magnetostrictive element 130 is also increased. As an example, it is found that an excitation current of 0.2 A (2V) generates a flexural displacement of 8.3 μm. Therefore, the earphone 100 can generate vibrations according to the size of an excitation current and allow the user to perceive the vibrations as sound.

Figure 6:
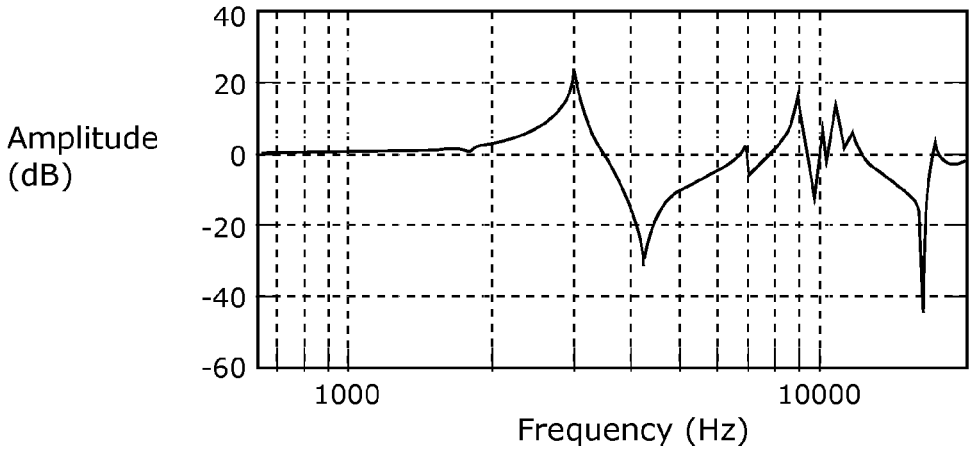
FIG. 6 is a graph showing amplitude with respect to vibration frequency of the earphone according to Embodiment 1.

FIG. 6 is a graph showing amplitude with respect to vibration frequency of the earphone 100. As shown in FIG. 6, it is found that in the earphone 100, since positive or negative vibration amplitude can be obtained in an audible range of 700 to 20000 Hz, it is effective as the earphone. It should be noted that in the earphone 100 according to the present embodiment, as an example, it is found that the resonance frequency is about 2.2 kHz and vibration acceleration level is greater than or equal to 60 dB in the audible range. Moreover, the earphone operates at low voltage and does not require an amplifier. In other words, the earphone can be used by connecting it to an earphone jack of a portable music player.

As described above, the earphone 100 according to the present embodiment comprises: a magnetostrictive element which is composed of a magnetostrictive material and has a column-like shape, the magnetostrictive element expanding and contracting due to magnetostrictive effect; a coil wound around the magnetostrictive element, the coil converting an electrical signal into a change in magnetic field; and an elastic portion which is composed of an elastic body having magnetism, the elastic portion including: a first elastic portion to which one of ends of the magnetostrictive element is joined; a second elastic portion to which the other end of the magnetostrictive element is joined; and a beam portion having a column-like shape and being provided in parallel to the magnetostrictive element between the first elastic portion and the second elastic portion and being integrally formed with the first elastic portion and the second elastic portion.

With this configuration, the vibrations corresponding to an electrical signal is transmitted from the magnetostrictive element via the elastic portion, the user can perceive the sound corresponding to the electrical signal. Moreover, since in the earphone 100, the elastic portion 110 has openings, the user can perceive surrounding sounds which pass through the openings. With this, the user can hear surrounding sounds as well as sound from the earphone 100 while wearing the earphone 100. Moreover, since the earphone 100 is used by inserting it into the ear hole, the earphone 100, different from the headset, does not have to put pressure on the head region of the user when the earphone is worn. Therefore, with a low degree of invasiveness, it is possible to provide the earphone 100 which does not prevent the user from hearing surrounding sounds.

It should be noted that the above described earphone may have a configuration in which a terminal and an earphone line for applying an electrical signal are included, and may have a configuration in which a back yoke is included. Moreover, since a bias magnetic field is applied to the magnetostrictive element 130, the above described earphone can be used as a microphone due to inverse magnetostrictive effect.

Moreover, the above described earphone may be used as an ear-worn bone conduction device by making the elastic portion abut against the ear canal of the ear hole.

The following will describe, as variations of the present embodiment, an earphone including a back yoke and an ear-worn bone conduction device using bone conduction.

(Variation 1)

The following will describe a variation of Embodiment 1.

The earphone 100 according to Embodiment 1 may be a configuration in which a back yoke is further included. The back yoke is so called heel piece (yoke) and is formed with a magnetic body. The back yoke may be used as a yoke which allows, to pass, a magnetic flux caused by the coil 120 or a magnetic flux caused by the magnet. In other words, the earphone 100 can reduce the leakage of a magnetic flux passing through the magnetostrictive element, by including the back yoke. With this, the total number of magnets to be located at the earphone 100 can be reduced.

For example, the back yoke may be a configuration in which the magnets exist at both ends for applying a bias magnetic field to the magnetostrictive element 130 and a configuration which allows the magnetic flux generated by the magnet to pass. In terms of reducing power consumption, it is favorable that a permanent magnet is used as the magnet of the above described earphone 100. However, an electromagnet may be used as the magnet.

Moreover, by including the back yoke, a closed magnetic circuit is configured and the generation amount of magnetic flux per unit current can be increased. Therefore, since the magnetic flux density per unit current generated in the inside of the magnetostrictive element 130 is strengthened, the earphone can be operated with less power consumption.

(Variation 2)

The following will describe Variation 2 of Embodiment 1.

Moreover, the above described earphone may be used as an ear-worn bone conduction device in which the elastic portion abuts against the ear canal of the ear hole and transmits vibrations between the magnetostrictive element and the ear canal.

In other words, in the above described earphone, by making the diaphragms 140*a* and 140*b* abut against the ear canal, the vibrations generated by the magnetostrictive element 130 are transmitted to the ear canal of the user's ear hole via the elastic portion 110, and the diaphragms 140*a* and 140*b*.

With this, since the vibrations corresponding to an electrical signal are transmitted to the ear canal from the magnetostrictive element 130, the user can obtain the sound corresponding to the electrical signal as a bone conduction sound. Moreover, since in the ear-worn bone conduction device, the elastic portion has openings (through holes), the user can obtain, as an air conduction sound, surrounding sounds which pass through the openings. With this, the user can listen to the sound corresponding to the electrical signal and the surrounding sounds while wearing the ear-worn bone conduction device.

Embodiment 2

The following will describe an earphone 500 according to Embodiment 2 of the present invention. The difference of the earphone 500 according to the present embodiment from the earphone 100 according to Embodiment 1 is that it has a step type structure in which an elastic portion 510 and diaphragms 540*a* and 540*b* have steps, and that the diaphragms 540*a* and 540*b* include silicone caps 550*a* and 550*b*, respectively.

Figure 7:
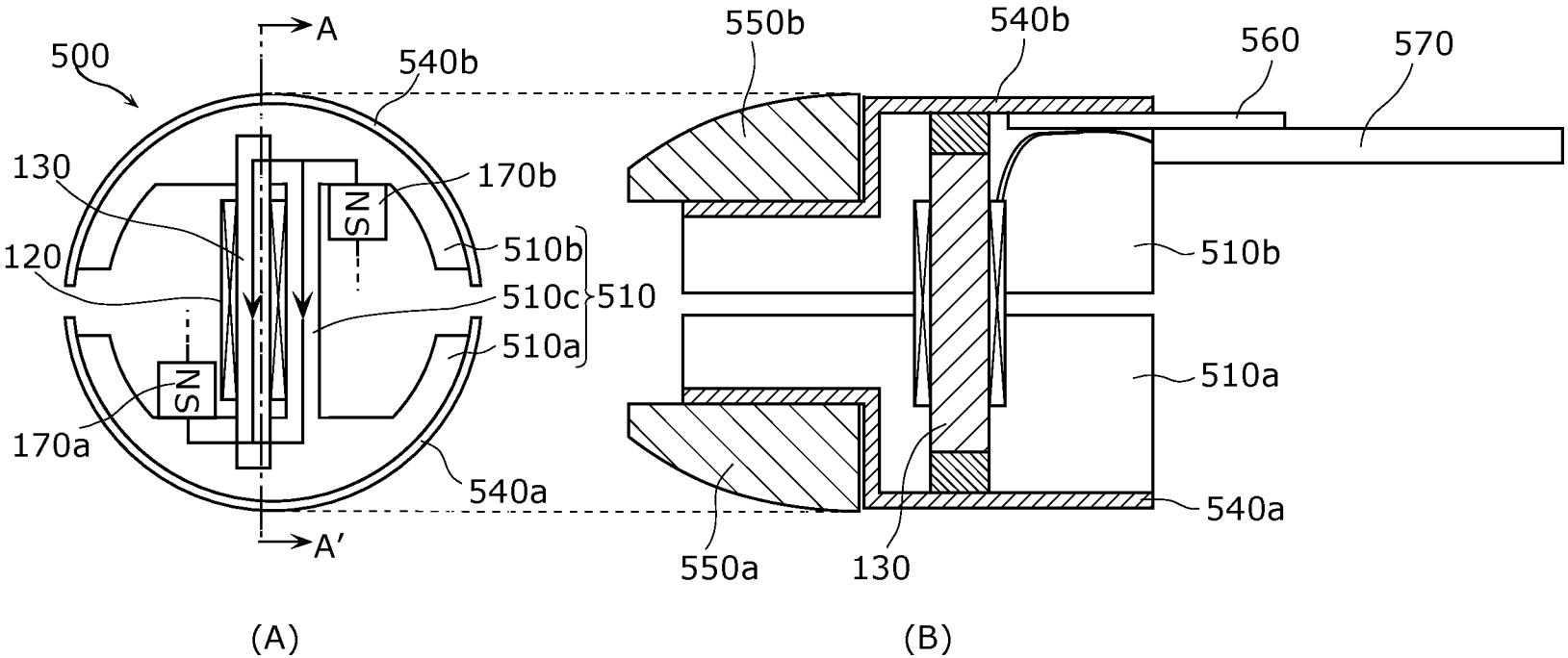
FIG. 7 is a schematic view showing the configuration of an earphone according to Embodiment 2.

(A) and (B) of FIG. 7 each are a schematic view showing the configuration of the earphone 500 according to the present embodiment. More specifically, (A) of FIG. 7 is an elevation view of the earphone 500 according to the present embodiment, and (B) of FIG. 7 is an A-A' line cross sectional view in (A) of FIG. 7.

As shown in (A) and (B) of FIG. 7, the earphone 500 according to the present embodiment includes an elastic portion (yoke and frame) 510, the magnetostrictive element 130, the coil 120, the diaphragms 540*a* and 540*b*, the magnets 170*a* and 170*b*, the silicone caps 550*a* and 550*b*, a terminal 560, and an earphone line 570. The magnetostrictive element 130, the coil 120, and the magnets 170*a* and 170*b* are the same as the magnetostrictive element 130, the coil 120, and the magnets 170*a* and 170*b* in the earphone 100 according to Embodiment 1, and therefore description thereof will be omitted.

The elastic portion 510 has a circular shape, when viewed from a direction in which the earphone 500 is located at the inside of the ear hole such that the earphone 500 abuts against the ear hole without imposing a burden on the user. The elastic portion 510 has two interspaces, one of which is located at the top and the other of which is located at the bottom, respectively. The elastic portion 510 includes the first elastic portion 510*a* and the second elastic portion 510*b* partially having arc-like shapes, and the beam portion 110*c* having a column-like shape which is provided between the first elastic portion 510*a* and the second elastic portion 510*b* and which is integrally formed with the first elastic portion 510*a* and the second elastic portion 510*b* such that the beam portion 510*c* can be connected between the first elastic portion 510*a* and the second elastic portion 510*b*.

Here, the first elastic portion 510*a* and the second elastic portion 510*b*, as shown in (B) of FIG. 7, have a step type structure in which steps are formed such that the diameter of the circular form is smaller for the elastic portion 510 located on the inside of the ear hole when the user wears the earphone. As an example, the diameter (inner diameter) of the elastic portion 510 on the side of which the diameter of the circular shape is smaller is 6 mm, and the diameter (outer diameter) of the elastic portion 510 on the side of which the diameter of the circular shape is larger is 12 mm.

The diaphragms 540*a* and 540*b* are joined to the arc-shaped portions of the first elastic portion 510*a* and the second elastic portion 510*b*. The diaphragms 540*a* and 540*b* each have a step shape along with the shapes of the first elastic portion 510*a* and the second elastic portion 510*b*, respectively.

Furthermore, on the side located at the inside of the ear hole when the user wears the earphone, in other words, on the diaphragms 540*a* and 540*b* on the side of which the diameter is smaller each for the circular shapes of the first elastic portion 510*a* and the second elastic portion 510*b*, the silicone caps 550*a* and 550*b* composed of silicone resin are located, respectively. The inner diameter is 7 to 8 mm, as an example, when the silicone caps 550*a* and 550*b* are located. With this configuration, the diaphragms 540*a* and 540*b* can be located along with the shape of the user's ear hole.

It should be noted that the silicone caps 550*a* and 550*b* may be a cap including not only a silicone resin but also a flexible material such as urethane foam and other resins.

Moreover, the terminal 560 is formed on the diaphragm 540*b*, and the earphone line 570 for applying current to the coil 120 and a fine metal line forming the coil 120 are connected to each other via the electrode of the terminal 560. With this configuration, the fine metal line included in the coil 120 can avoid being cut when the earphone line 570 is pulled out.

It should be noted that the terminal 560 may be formed on not only the diaphragm 540*a* but also the diaphragm 540*b*.

Moreover, similarly to the earphone 100 according to Embodiment 1, the above described earphone 500 may also be used as an ear-worn bone conduction device using bone conduction.

Embodiment 3

The following will describe an earphone 600 according to Embodiment 3 of the present invention. The difference of the earphone 600 according to the present embodiment from the earphone 100 according to Embodiment 1 is that the earphone 600 includes silicone caps 650*a* and 650*b* on the whole area surrounding the diaphragms 640*a* and 640*b*.

Figure 8:
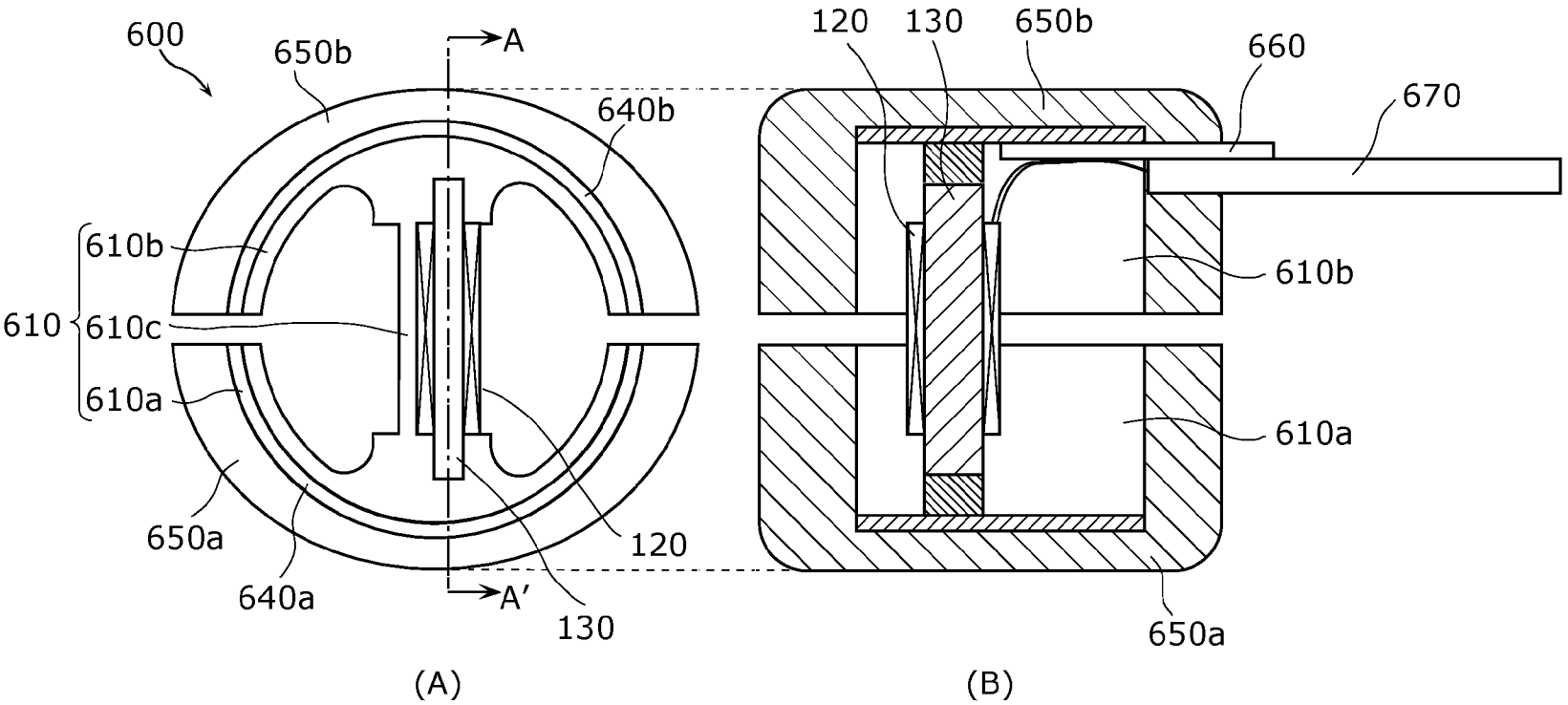
FIG. 8 is a schematic view showing the configuration of an earphone according to Embodiment 3.

(A) and (B) of FIG. 8 each are a diagram showing the configuration of the earphone 600 according to the present embodiment. For further details, (A) of FIG. 8 is an elevation view of the earphone 600 according to the present embodiment, and (B) of FIG. 8 is an A-A' line cross sectional view in (A) of FIG. 8.

As shown in (A) and (B) of FIG. 8, the earphone 600 according to the present embodiment includes an elastic portion (yoke and frame) 610, the magnetostrictive element 130, the coil 120, the diaphragms 640*a* and 640*b*, the magnets (not illustrated), the silicone caps 650*a* and 650*b*, a terminal 660, and an earphone line 670. The magnetostrictive element 130, the coil 120, and the magnets are the same as the magnetostrictive element 130, the coil 120, and the magnets 170*a* and 170*b* in the earphone 100 according to Embodiment 1, and therefore a detailed description thereof will be omitted.

The elastic portion 610 has a circular shape such that the earphone 600 abuts against the surface of the ear hole without imposing a burden on the user. The elastic portion 610 has two interspaces. The elastic portion 610 includes the first elastic portion 610*a* and the second elastic portion 610*b* that partially have arc-like shapes, and the beam portion 610*c* having a column-like shape which is located in parallel to the magnetostrictive element 130 between the first elastic portion 610*a* and the second elastic portion 610*b* and which is integrally formed with the first elastic portion 610*a* and the second elastic portion 610*b* such that the beam portion 610*c* can be connected between the first elastic portion 610*a* and the second elastic portion 610*b*.

Here, in the earphone 600, as shown in (B) of FIG. 8, the silicone caps 650*a* and 650*b* composed of silicone resin are located to cover the whole area surrounding the diaphragms 640*a* and 640*b*, and the first elastic portion 610*a* and the second elastic portion 610*b*. The silicone caps 650*a* and 650*b*, as shown in (A) of FIG. 8, have an elliptical shape in which the thickness near the interspace formed in the elastic portion 610 is large and the thickness near both ends of the magnetostrictive element 130 is small, when viewed from a direction in which the earphone 600 is located at the inside of the ear hole.

With this configuration, even when the elastic portion 610 is not formed in a step type structure like the elastic portion 510 according to Embodiment 2, the earphone 600 can fit deeply into the user's ear hole. Moreover, since the silicone caps 650*a* and 650*b* which are the parts of which the elastic portion 610 shows the largest displacement by the expansion and contraction of the magnetostrictive element 130 are formed with sufficient thickness by providing the silicone caps 650*a* and 650*b* with an elliptical shape, the parts of the silicone caps 650*a* and 650*b*, which are formed to be thicker when the earphone 600 is located at the inside of the ear, contract further than others, and therefore the parts are in soft contact with the skin. Therefore, the earphone 600 can be located along with the shape of the user's ear hole.

It should be noted that the silicone caps 650*a* and 650*b* may be a cap including not only a silicone resin but also a cap including a flexible material such as urethane foam and other resins.

Moreover, similarly to the earphone 500 according to Embodiment 2, the terminal 660 is formed on the diaphragm 640*b* of the earphone 600, and the earphone line 670 for applying current to the coil 120 and a fine metal line forming the coil 120 are connected to each other via the electrode of the terminal 660. With this configuration, the fine metal line included in the coil 210 can avoid being cut when the earphone line 670 is pulled out.

It should be noted that the terminal 660 may be formed on not only the diaphragm 640*b* but also the diaphragm 640*a*.

Moreover, similarly to the earphone 100 according to Embodiment 1, the above described earphone 600 may also be used as an ear-worn bone conduction device using bone conduction.

Embodiment 4

The following will describe an earphone 700 according to Embodiment 4 of the present invention. The difference of the earphone 700 according to the present embodiment from the earphone 100 according to Embodiment 1 is that the earphone 700 includes a silicone cap 750 on the whole area surrounding a first elastic portion 710*a* and a second elastic portion 710*b*, an elastic portion 710 has an almost H shape on an A-A' line cross sectional surface, and the earphone 700 is formed in an elongated shape in a direction toward the inside of the ear hole, when viewed in a direction in which the earphone 700 is located at the inside of the ear hole.

Figure 9:
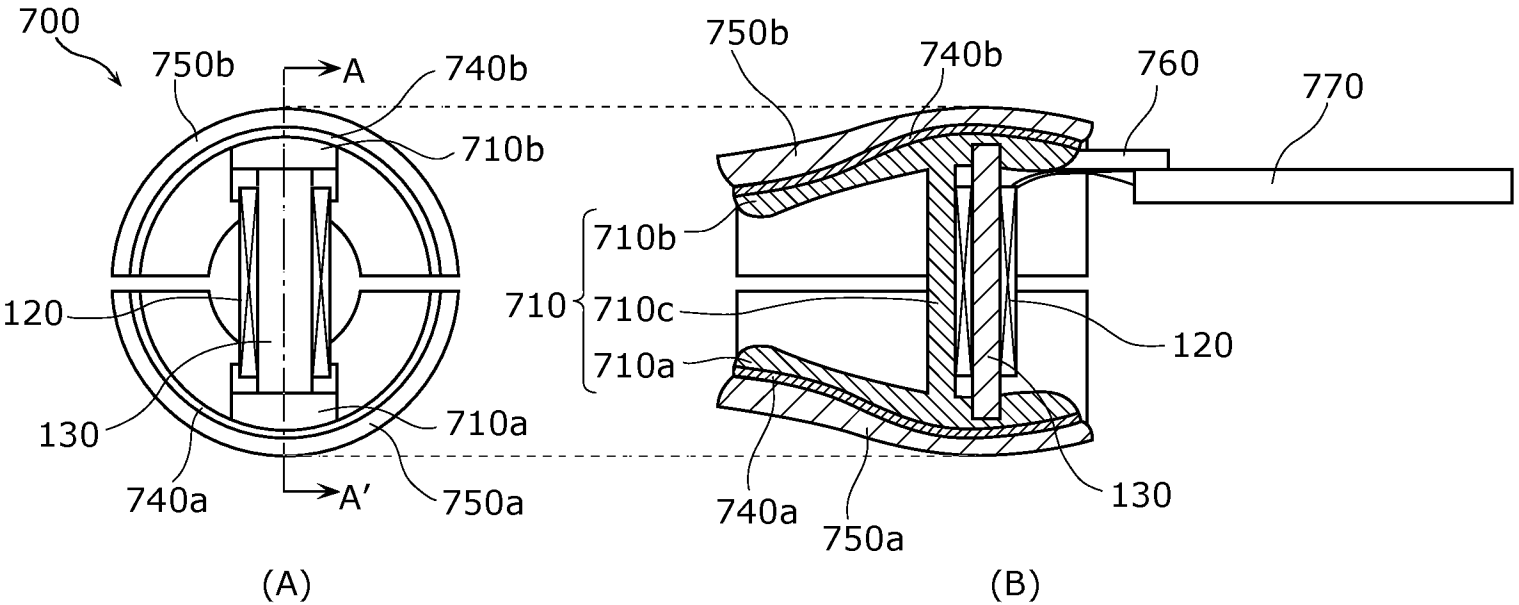
FIG. 9 is a schematic view showing the configuration of an earphone according to Embodiment 4.

(A) and (B) of FIG. 9 each are a schematic view showing the configuration of the earphone 700 according to the present embodiment. For further details, (A) of FIG. 9 is an elevation view of the earphone 700 according to the present embodiment, and (B) of FIG. 9 is an A-A' line cross sectional view in (A) of FIG. 9.

As shown in (A) and (B) of FIG. 9, the earphone 700 according to the present embodiment includes the elastic portion (yoke and frame) 710, the magnetostrictive element 130, the coil 120, the magnets (not illustrated), a diaphragm 740, the silicone cap 750, a terminal 660, and an earphone line 770. The magnetostrictive element 130, the coil 120, and the magnets are the same as the magnetostrictive element 130, the coil 120, and the magnets 170*a* and 170*b* in the earphone 100 according to Embodiment 1, and therefore a detailed description thereof will be omitted.

The elastic portion 710 has two interspaces. The elastic portion 710 includes a first elastic portion 710*a*, a second elastic portion 710*b*, and a beam portion 710*c* which is provided between the first elastic portion 710*a* and the second elastic portion 710*b* and which is integrally formed with the first elastic portion 710*a* and the second elastic portion 710*b* such that the beam portion 710*c* can be connected between the first elastic portion 710*a* and the second elastic portion 710*b*. In other words, the elastic portion 710, as shown in (B) of FIG. 9, has an almost H shape on an A-A' line cross sectional surface, and has two interspaces, one of which is located in the inside of the ear hole and the other of which is located at the entrance of the ear hole. Moreover, the elastic portion 710 is formed in an elongated shape in a direction toward the inside of the ear hole. Moreover, the elastic portion 710, along with the shape of the ear hole, curves in a direction in which respective ones of the end sides of the first elastic portion 710*a* and the second elastic portion 710*b* that are located at the inside of the ear hole are mutually adjacent.

Moreover, the first elastic portion 710*a* is connected to the diaphragm 740*a*, while the second elastic portion 710*b* is connected to the diaphragm 740*b*. The diaphragms 740*a* and 740*b*, when viewed as the whole in a direction toward the inside of the ear hole, have a cylindrical shape having an interspace between the diaphragms 740*a* and 740*b*. Furthermore, silicone caps 750*a* and 750*b* composed of silicone resin are located on the diaphragms 740*a* and 740*b*, respectively. The above described inner diameter is about 7 to 8 mm, as an example, when the silicone caps 750*a* and 750*b* are located.

With this configuration, the diaphragms 740*a* and 740*b* can be located along with the shape of the user's ear hole.

It should be noted that in the earphone 700, the diaphragm 740 may be formed to cover, in a ring-like shape, the surrounding areas of the first elastic portion 710*a* and the second elastic portion 710*b*. Furthermore, the silicone cap 750 composed of silicone resin may be located around the diaphragm 740. Therefore, the earphone 700 may be formed in a cylindrical shape without an interspace between the diaphragms 740*a* and 740*b*, when viewed in a direction toward the inside of the ear hole. In this case, the diaphragm 740 and the silicone cap 750 may have a configuration in which part of the cylindrical shape has a folding line for making it easier to perform bending deformation, instead of the configuration in which the above described interspace is included. Moreover, the earphone 800 may not only have a cylindrical shape but also other shapes as long as they are a shape along with the shape of the user's ear hole.

With this configuration, even when the elastic portion 710 is not formed in a step type structure like the elastic portion 510 according to Embodiment 2, the earphone 700 can fit deeply into the user's ear hole. Moreover, since the silicone cap 750 is located to cover the whole areas surrounding the first elastic portion 710*a* and the second elastic portion 710*b*, the silicone cap 750 can be located to be in soft contact with the user's ear hole and can be located along with the shape of the user's ear hole.

It should be noted that the silicone caps 750 may be a cap including not only a silicone resin but also a cap including a flexible material such as urethane foam and other resins.

Moreover, similarly to the earphone 500 according to Embodiment 2, the terminal 760 is formed on the second elastic portion 710*b* of the earphone 700, and the earphone line 770 for applying current to the coil 120 and a fine metal line forming the coil 120 are connected to each other via the electrode of the terminal 760. With this configuration, the fine metal line included in the coil 120 can avoid being cut when the earphone line 770 is pulled out.

It should be noted that the terminal 760 may be formed on not only the second elastic portion 710*b* but also the first elastic portion 710*a*. Moreover, the elastic portion 710 may have a configuration in which the diaphragm is located on the surrounding area of the elastic portion 710.

Moreover, similarly to the earphone 100 according to Embodiment 1, the above described earphone 700 may also be used as an ear-worn bone conduction device using bone conduction.

Embodiment 5

The following will describe an earphone 800 according to Embodiment 5 of the present invention.

Figure 10:
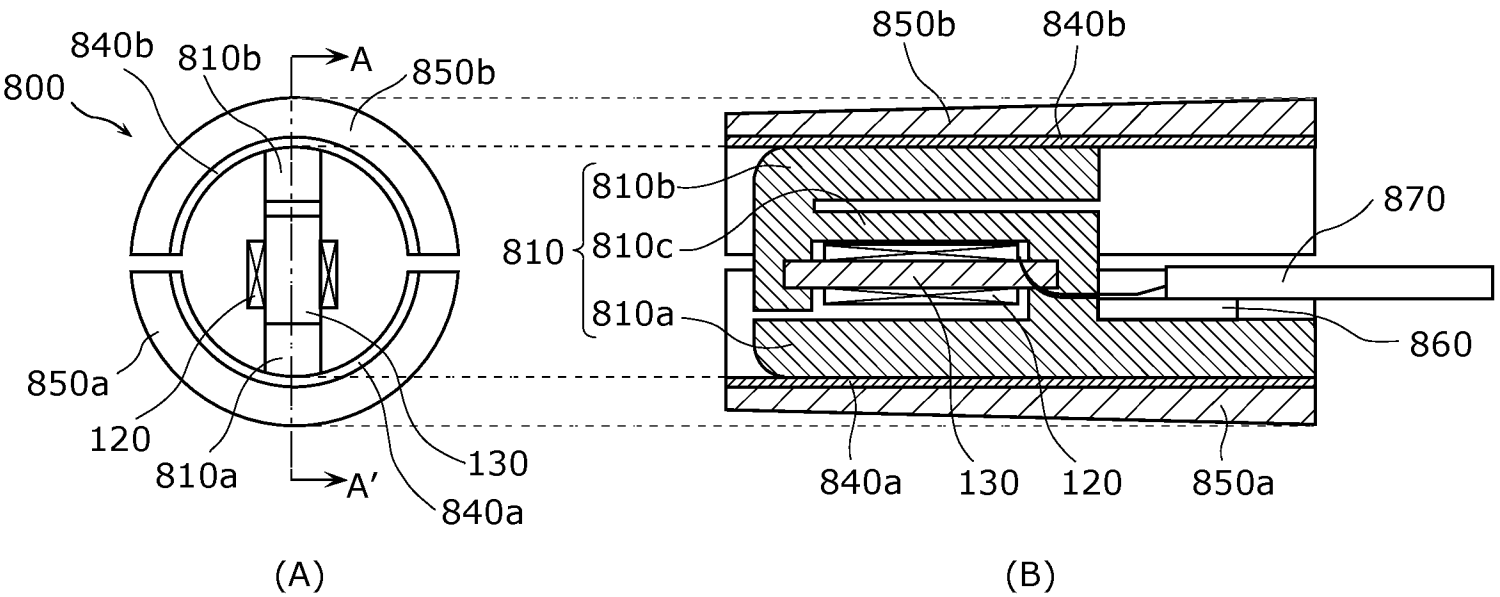
FIG. 10 is a schematic view showing the configuration of an earphone according to Embodiment 5.

(A) and (B) of FIG. 10 each are a schematic view showing the configuration of the earphone 800 according to the present embodiment. For further details, (A) of FIG. 10 is an elevation view of the earphone 800 according to the present embodiment, and (B) of FIG. 10 is an A-A' line cross sectional view in (A) of FIG. 10.

As shown in (A) and (B) of FIG. 10, the earphone 800 according to the present embodiment includes an elastic portion (yoke and frame) 810, the magnetostrictive element 130, the coil 120, the magnets (not illustrated), a diaphragm 840, a silicone cap 850, a terminal 860, and an earphone line 870. The magnetostrictive element 130, the coil 120, and the magnets are the same as the magnetostrictive element 130, the coil 120, and the magnets 170*a* and 170*b* in the earphone 100 according to Embodiment 1, and therefore a detailed description thereof will be omitted.

The elastic portion 810 has two interspaces. The elastic portion 810 includes a first elastic portion 810*a*, a second elastic portion 810*b*, and a beam portion 810*c* which is provided between the first elastic portion 810*a* and the second elastic portion 810*b* and which is integrally formed with the first elastic portion 810*a* and the second elastic portion 810*b* such that the beam portion 810*c* can be connected between the first elastic portion 810*a* and the second elastic portion 810*b*. Moreover, the first elastic portion 810*a* and the second elastic portion 810*b* are formed such that parts of the first elastic portion 810*a* and the second elastic portion 810*b* are in parallel to the beam portion 810*c*. Therefore, as shown in (B) of FIG. 10, in the A-A' line cross sectional surface, the first elastic portion 810*a*, the second elastic portion 810*b*, and the beam portion 810*c* are located in parallel to the magnetostrictive element 130. In other words, the elastic portion 810 has two interspaces, one of which is located between the first elastic portion 810*a* at the inside of the ear hole and the beam portion 810*c* and the other of which is located between the second elastic portion 810*b* at the entrance of the ear hole and the beam portion 810*c*. Furthermore, the magnetostrictive element 130 is located to be elongated in a direction toward the inside of the ear hole. Therefore, the first elastic portion 810*a*, the second elastic portion 810*b*, and the beam portion 810*c* are located in an elongated form in a direction toward the inside of the ear hole, when viewed in a direction toward the inside of the ear hole.

Moreover, the first elastic portion 810*a* is connected to the diaphragm 840*a*, while the second elastic portion 810*b* is connected to the diaphragm 840*b*. The diaphragms 840*a* and 840*b*, when viewed as the whole in a direction toward the inside of the ear hole, have a cylindrical shape having an interspace between the diaphragms 840*a* and 840*b*. Furthermore, silicone caps 850*a* and 850*b* composed of silicone resin are located on the diaphragms 840*a* and 840*b*, respectively. The above described inner diameter is 7 to 8 mm, as an example, when the silicone caps 850*a* and 850*b* are located.

With this configuration, the diaphragms 840*a* and 840*b* can be located along with the shape of the user's ear hole.

It should be noted that in the earphone 800, the diaphragm 840 may be formed to cover, in a ring-like shape, the surrounding areas of the first elastic portion 810*a* and the second elastic portion 810*b*. Furthermore, the silicone cap 850 composed of silicone resin may be located around the diaphragm 840. Therefore, the earphone 800 may be formed in a cylindrical shape without an interspace between the diaphragms 840*a* and 840*b*, when viewed in a direction toward the inside of the ear hole. In this case, the diaphragm 840 and the silicone cap 850 may have a configuration in which part of the cylindrical shape has a folding line for making it easier to perform bending deformation, instead of the configuration in which the above described interspace is included. Moreover, the earphone 800 may not only have a cylindrical shape but also other shapes as long as they are a shape along with the shape of the user's ear hole.

With this configuration, even when the elastic portion 810 is not formed in a step type structure like the elastic portion 510 according to Embodiment 2, the earphone 800 can be worn deeply into the user's ear hole. Moreover, since the silicone cap 850 is located to cover the whole areas surrounding the first elastic portion 810*a* and the second elastic portion 810*b*, the silicone cap 850 can be located to be in soft contact with the user's ear hole. Therefore, the diaphragms 840*a* and 840*b* can be located along with the shape of the user's ear hole.

It should be noted that the silicone caps 850 may be a cap including not only a silicone resin but also a cap including a flexible material such as urethane foam and other resins.

Moreover, similarly to the earphone 500 according to Embodiment 2, the terminal 860 is formed on the first elastic portion 810*a* of the earphone 800, and the earphone line 870 for applying current to the coil 120 and a fine metal line forming the coil 120 are connected to each other via the electrode of the terminal 860. With this configuration, the fine metal line included in the coil 120 can avoid being cut when the earphone line 870 is pulled out.

It should be noted that the terminal 860 may be formed on not only the first elastic portion 810*a* but also the second elastic portion 810*b*. Moreover, the elastic portion 810 may have a configuration in which the diaphragm is located on the surrounding area of the elastic portion 810.

Moreover, similarly to the earphone 100 according to Embodiment 1, the above described earphone 800 may also be used as an ear-worn bone conduction device using bone conduction.

The earphone according to the embodiments of the present invention has been described. However, the present invention is not limited to only the embodiments.

For example, the above described earphone may have a configuration in which a back yoke is included. In this case, the adjustment of magnetic resistance for adjusting magnetic flux intensity to be generated within the magnetostrictive element can be made easier by changing the shape of the back yoke, for example.

Moreover, the above described elastic portion may further have, on the outer circumference of the elastic portion, a shock absorbing portion which is in soft contact with the ear hole. A material of the shock absorbing portion can include rubber, silicone resin, and the like, for example.

It should be noted that in the above described embodiments, a permanent magnet is used as the magnet. However, an electromagnet may be used as the magnet. When an electromagnet is used as the magnet, a bias magnetic field can be generated by the flow of a constant amount of current in the magnet.

It should be noted that a plurality of the devices (earphones) according to the above described embodiments may be joined. For example, a form is acceptable in which a device used as the bone conduction speaker and a device used as a microphone are arranged and joined to each other such that the centers of the ring-like shapes of the elastic portions match with each other. Moreover, the two earphones may be joined to each other such that the centers of the ring-shaped elastic portions match with each other and the magnetostrictive elements 130 are perpendicular to each other in a direction when viewed from the front surface of the ring-like shape.

Moreover, the elastic portion may have a configuration without an interspace. When the elastic portion is an integrated type in which there is no interspace, there is a demerit that the displacement of the elastic portion caused by vibrations of the magnetostrictive element is decreased and there is a merit that the rigidity of the elastic portion is increased. It should be noted that the elastic portion may have only one interspace.

Moreover, the earphone according to the above described embodiments may include two or more magnetostrictive elements. In this case, by making the orientations of the magnetic field generated within the magnetostrictive element align in the same direction, it is possible to generate larger expansion and contraction deformation.

In the drawings describing the above described Embodiments 1 to 5, the corner portions and sides of the structural elements of the earphone are illustrated in a linear fashion. However, for the manufacturing reason, the rounder corner portions and sides of the structural elements are also included in the present invention.

Moreover, at least parts of the earphone according to the above described Embodiments 1 to 5 may be combined.

Moreover, the present invention can be implemented as an ear-worn bone conduction device including the above described earphone.

Although only some exemplary embodiments of the present invention have been described in detail above, those skilled in the art will readily appreciate that many modifications are possible in the exemplary embodiments without materially departing from the novel teachings and advantages of the present invention. Accordingly, all such modifications are intended to be included within the scope of the present invention.

The present invention can be applied to an earphone, a speaker, a microphone, and the like which convert one of the obtained electrical signal and vibrations into the other.

The invention claimed is:

1. An earphone, comprising:

a magnetostrictive element which is composed of a magnetostrictive material and has a column-like shape, the magnetostrictive element expanding and contracting due to magnetostrictive effect;

a coil wound around the magnetostrictive element, the coil converting an electrical signal into a change in magnetic field; and an elastic portion which is composed of an elastic body having magnetism, the elastic portion including: a first elastic portion to which one of ends of the magnetostrictive element is joined; a second elastic portion to which the other end of the magnetostrictive element is joined; and a beam portion having a column-like shape and being provided in parallel to the magnetostrictive element between the first elastic portion and the second elastic portion and being integrally formed with the first elastic portion and the second elastic portion;

wherein the magnetostrictive element, the beam portion, the first elastic portion, and the second elastic portion are arranged such that expansion and contraction of the magnetostrictive element causes deformation of said elastic portion such that the first and second elastic portions of said elastic portion are flexurally displaced in a direction orthogonal to a longitudinal direction of the magnetostrictive element.

2. An ear-worn bone conduction device, comprising the earphone according to claim 1, wherein the elastic portion abuts against an ear canal and transmits vibrations between the magnetostrictive element and the ear canal.

3. The earphone according to claim 1, wherein the first elastic portion includes a first magnet configured to apply a bias magnetic field to the magnetostrictive element, the second elastic portion includes a second magnet configured to apply a bias magnetic field to the magnetostrictive element, and the first magnet and the second magnet have a same magnetic field orientation, and are located in an orientation in which each of the first magnet and the second magnet generates a magnetic field in a same direction as a longitudinal direction of the magnetostrictive element.

4. The earphone according to claim 1, wherein the elastic portion includes a diaphragm around which the elastic portion abuts against an ear hole.

5. An earphone, comprising:

a magnetostrictive element which is composed of a magnetostrictive material and has a column-like shape, the magnetostrictive element expanding and contracting due to magnetostrictive effect;

a coil wound around the magnetostrictive element, the coil converting an electrical signal into a change in magnetic field; and an elastic portion which is composed of an elastic body having magnetism, the elastic portion including: a first elastic portion to which one of ends of the magnetostrictive element is joined; a second elastic portion to which the other end of the magnetostrictive element is joined; and a beam portion having a column-like shape and being provided in parallel to the magnetostrictive element between the first elastic portion and the second elastic portion and being integrally formed with the first elastic portion and the second elastic portion;

wherein the elastic portion has a circular shape when viewed in a direction in which the elastic portion is located inside the ear hole, and becomes thinner in an area to be located inside the ear hole than in an area to be located at an entrance side of the ear hole.

6. An earphone, comprising:

a magnetostrictive element which is composed of a magnetostrictive material and has a column-like shape, the magnetostrictive element expanding and contracting due to magnetostrictive effect;

a coil wound around the magnetostrictive element, the coil converting an electrical signal into a change in magnetic field; and an elastic portion which is composed of an elastic body having magnetism, the elastic portion including: a first elastic portion to which one of ends of the magnetostrictive element is joined; a second elastic portion to which the other end of the magnetostrictive element is joined; and a beam portion having a column-like shape and being provided in parallel to the magnetostrictive element between the first elastic portion and the second elastic portion and being integrally formed with the first elastic portion and the second elastic portion;

wherein the elastic portion has a circular shape when viewed in a direction in which the elastic portion is located inside the ear hole, and includes a step which makes the elastic portion thinner in an area to be located inside the ear hole than in an area to be located at an entrance side of the ear hole.

7. An ear-worn bone conduction device, comprising the earphone according to claim 3, wherein the elastic portion abuts against an ear canal and transmits vibrations between the magnetostrictive element and the ear canal.

8. An ear-worn bone conduction device, comprising the earphone according to claim 4, wherein the elastic portion abuts against an ear canal and transmits vibrations between the magnetostrictive element and the ear canal.

9. An ear-worn bone conduction device, comprising the earphone according to claim 5, wherein the elastic portion abuts against an ear canal and transmits vibrations between the magnetostrictive element and the ear canal.

10. An ear-worn bone conduction device, comprising the earphone according to claim 6, wherein the elastic portion abuts against an ear canal and transmits vibrations between the magnetostrictive element and the ear canal.

11. The earphone according to claim 5, wherein the first elastic portion includes a first magnet configured to apply a bias magnetic field to the magnetostrictive element, the second elastic portion includes a second magnet configured to apply a bias magnetic field to the magnetostrictive element, and the first magnet and the second magnet have a same magnetic field orientation, and are located in an orientation in which each of the first magnet and the second magnet generates a magnetic field in a same direction as a longitudinal direction of the magnetostrictive element.

12. The earphone according to claim 6, wherein the first elastic portion includes a first magnet configured to apply a bias magnetic field to the magnetostrictive element, the second elastic portion includes a second magnet configured to apply a bias magnetic field to the magnetostrictive element, and the first magnet and the second magnet have a same magnetic field orientation, and are located in an orientation in which each of the first magnet and the second magnet generates a magnetic field in a same direction as a longitudinal direction of the magnetostrictive element.

13. The earphone according to claim 5, wherein the elastic portion includes a diaphragm around which the elastic portion abuts against an ear hole.

14. The earphone according to claim 6, wherein the elastic portion includes a diaphragm around which the elastic portion abuts against an ear hole.

* * * * *